US005711580A

United States Patent [19]

Barclay et al.

[11] Patent Number: 5,711,580

[45] Date of Patent: Jan. 27, 1998

[54] EXTENDIBLE AND ELEVATING FOOTREST FOR WHEELCHAIR

[75] Inventors: Hugh Walter Barclay, Kingston; David Millard Christy, Godfrey, both of Canada

[73] Assignee: Advanced Mobility Systems Corporation, Kingston, Canada

[21] Appl. No.: 713,695

[22] Filed: Sep. 13, 1996

[51] Int. Cl.[6] ..... A47C 7/50

[52] U.S. Cl. ..... 297/423.33; 297/423.36

[58] Field of Search ..... 297/423.33, 423.19, 297/423.23, 423.24, 423.25, 423.36, 423.29, 423.32, DIG. 4

[56] References Cited

U.S. PATENT DOCUMENTS 3,072,437 1/1963 Shea et al. ..... 297/423.32
3,376,067 4/1968 Kerns ..... 297/423.33 X

FOREIGN PATENT DOCUMENTS 490335 2/1953 Canada ..... 297/423.36
3223597 12/1983 Germany ..... 297/423.33

*Primary Examiner*—Laurie K. Cranmer
*Attorney, Agent, or Firm*—Adrian Zahl

[57] ABSTRACT

The device is a footrest support structure for attachment to the frame of a wheelchair. A footrest is carried on the end of a telescoping leg pivotally engaged to a wheelchair frame. The telescoping leg automatically extends as it is elevated, by means of a folding link that engages the two parts of the leg. The link is engaged as well by a lever lock that permits the first arm to slide freely in a first direction but not in a second direction until the lock is actuated. The first arm of the folding link is pivotally engaged to the upper leg at a first pivot point intermediate the ends of the first arm and the leg, respectively, for pivoting the arm in a generally vertical plane. The second arm is pivotally engaged at its lower end to the lower leg at a second pivot point. The distance between said first and second pivot points extends as the footrest support structure is elevated, thus causing the leg to elongate.

18 Claims, 5 Drawing Sheets

EXTENDIBLE AND ELEVATING FOOTREST FOR WHEELCHAIR

FIELD OF THE INVENTION

The invention relates to a supporting leg for a footrest, intended to form a component of a wheelchair, wherein the footrest may elevate to raise the user's legs. The invention further relates to a wheelchair that incorporates a footrest of this type.

BACKGROUND OF THE INVENTION

Wheelchairs intended for long-term use often incorporate a feature whereby the footrest may be elevated, to permit the user to elevate his feet while using the chair. Because the leg of the wheelchair user is typically longer than the length of the footrest structure, and the user's feet are prevented from sliding forward by the footrest, it is important to provide a means whereby the footrest structure is progressively lengthened as the leg rest is raised. This permits the user to maintain a natural bend to his legs without elevating his knees as the footrest is raised.

It is known to provide a footrest structure that telescopes outwardly as the footrest is elevated and inwardly as the footrest is lowered. The amount of elongation may be controlled by a folding link arrangement that connects upper and lower telescoping parts of the footrest support. U.S. Pat. No. 3,858,938 (Kristensson et al.) discloses a folding link arrangement of this type. The link in this case is also connected to the wheelchair backrest. Other references that show the use of a folding link connecting the telescoping parts of the footrest support are:

U.S. Pat. No. 5,033,793 (Quintile)

U.S. Pat. No. 5,328,247 (Lovins)

U.S. Pat. No. 4,486,048 (Meyer)

The prior art devices typically represent complex solutions to the problem. It is desirable to provide a simplified means that serves both to extend the footrest support upon elevation, and to releasably lock the footrest structure in a desired elevated position. It is also desirable to provide a simple means to adjust the length of footrest support, to permit a wheelchair to accommodate users having different leg lengths.

SUMMARY OF THE INVENTION

The object of the present invention is to provide a footrest structure for a wheelchair, having means to permit the automatic extension of the structure upon elevation of the footrest, and lock the footrest in an elevated position. This objective is achieved by way of a footrest support structure for attachment to the frame of a wheelchair, wherein the structure comprises:

a) An elongate leg structure comprising upper and lower legs slideably disposed relative to each other, supporting a footrest at the lower end of the lower leg;

b) a support attached to the leg structure and hinged to a wheelchair frame, to pivotally engage the leg structure to the wheelchair frame to permit the leg structure to swing in a generally vertical plane;

c) a folding link comprised of first and second arms;

d) lock means attached to the support, and adapted to releasably engage the first arm. The lock means permits the first arm to slide freely in a first direction but not in a second direction until the lock is actuated.

The first arm of the folding link is pivotally engaged to the upper leg at a first pivot point intermediate the ends of the first arm and the leg, respectively, for pivoting the arm in a generally vertical plane. The second arm is pivotally engaged at its lower end to the lower leg at a second pivot point. The distance between said first and second pivot points extends as the footrest support structure is elevated, thus causing the leg to elongate.

The structure may be configured such that the second arm is entirely forward of the leg, and the second arm slides rearwardly through the lock as the leg is lowered and forwardly as the leg is raised.

In a preferred version, the lock means comprises a hinged pair of plates, biased away from each other, with an aperture through both plates through which the first arm extends. The arm may be drawn through the plates in a first direction, but is prevented from sliding through the apertures in the reverse direction by the offset angle of the respective plates, the lock is released by the plates being drawn together by the user.

The link may be provided with means to vary the length of one of the arms, in order to vary the length of the leg. This permits the chair to accommodate users having differing leg lengths. This may be achieved through the use of an arm that consists of two colinear members, having set screws or other engagement means to lock the two members together at variable lengths.

The first arm may be provided with a handle to permit the wheelchair user to elevate the footrest by pushing on the handle. Alternatively or in addition, the lock means may incorporate a ratchet mechanism that pushes the first arm forwardly upon actuation of the ratchet means.

The invention further comprises a wheelchair having dual footrest structures of the type described herein.

It will be understood that the terms "forwardly" and "rearwardly" relate to the front and rear of the wheelchair, respectively, while "upwardly" and "downwardly" are in reference to the normal upright orientation of the wheelchair.

DETAILED DESCRIPTION OF THE PREFERRED EMBODIMENT

Figure 1:
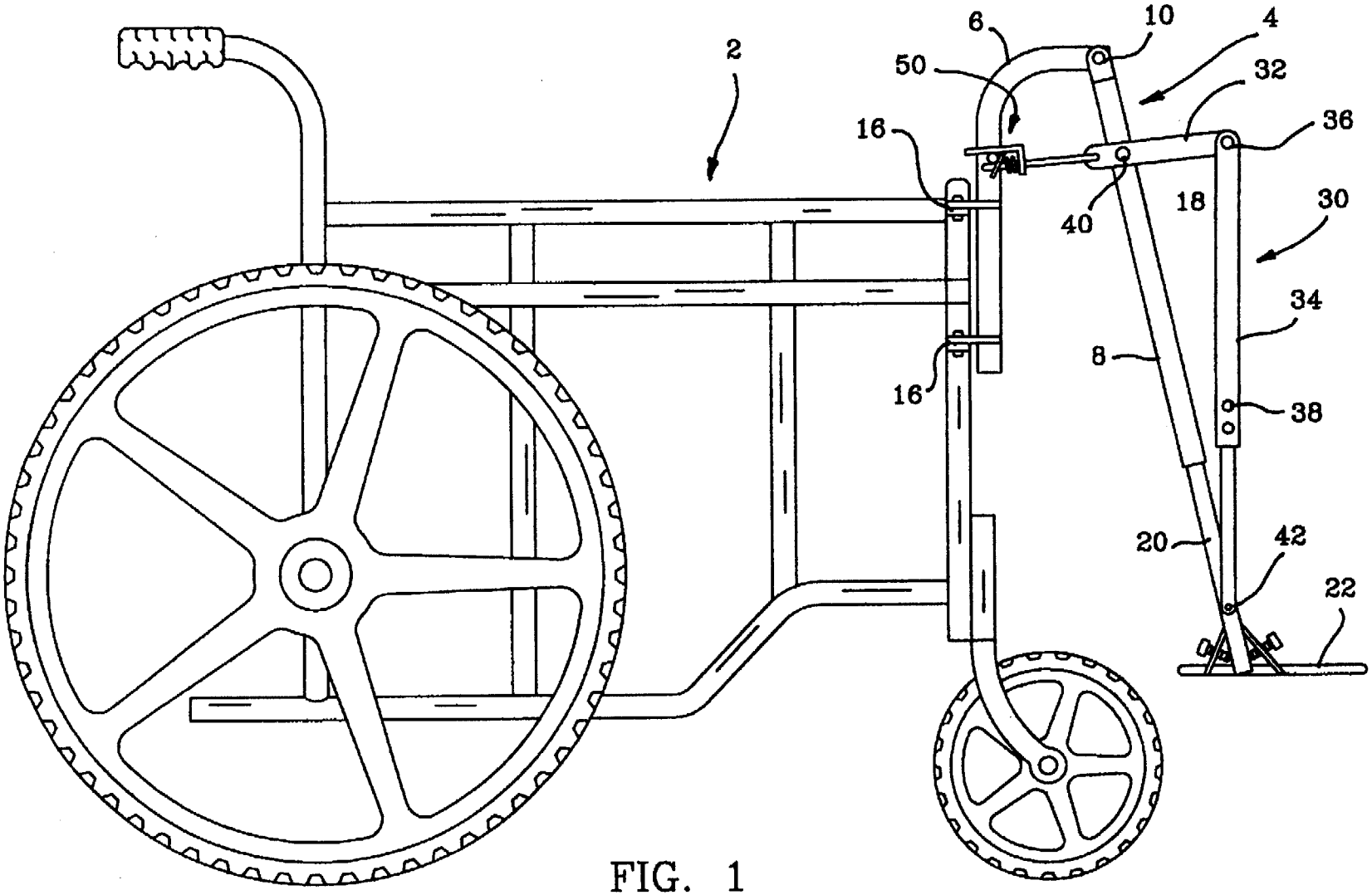
FIG. 1 is a side elevational view of a wheelchair, showing the present invention.

Referring to FIG. 1, portions of the wheelchair that are unrelated to the present invention have been removed for clarity.

A wheelchair frame 2, a portion of which is shown in FIG. 1, supports a pair of pivotally mounted footrest support structures 4. For purposes of clarity, only a single structure is described and illustrated herein. The structure, seen in FIGS. 1–3, comprises a gooseneck-shaped hanger 6 and a leg structure 8 pivotally engaged to the hanger 6 by means of a pivot pin 10 that permits the leg structure to pivot in the vertical plane. A hinge structure 16 links the hanger to the wheelchair frame and permits the leg structure to swing horizontally. The leg structure 8 consists of upper 18 and lower 20 legs that are co-axial and slideably disposed relative to each other. In the preferred embodiment, the lower leg telescopes from the upper leg. A platelike footrest 22 extends from the lower end of the lower leg 20. The support structure is shown here as having a generally square cross-sectional profile, however, it will be understood that the invention may be readily adapted to accommodate any acceptable leg shape, such as tubular or oval members.

A folding link 30 links the upper and lower legs, and is as well engaged to the hinge structure by means of a releasable lock mechanism, described below. As will be seen, the folding link serves to both lock the footrest support in an elevated position and to lengthen the leg upon raising of the support. The folding link comprises first and second arms 32 and 34, respectively, pivotally engaged to each other at joint 36. The second arm 34 is adjustable in length and consists of two telescoping parts, the overall length of which is fixed by means of set screws 38. The length of the second arm may be adjusted if it is desired to increase or reduce the overall length of the leg 8.

The link is engaged to the leg at first and second pivot points 40 and 42, respectively. The first pivot point engages the first arm 32 to the upper leg 18, at a position intermediate the ends of both respective members. The second pivot point 42 attaches the lower end of the second arm 34 to the lower leg. The second arm is positioned forwardly of the lower leg, by virtue of the positioning of the joint 36 forwardly of the leg. Thus, a triangle is formed by the folding link and the leg, permitting the link to extend the leg by a fixed amount upon elevation of the leg.

Figure 4:
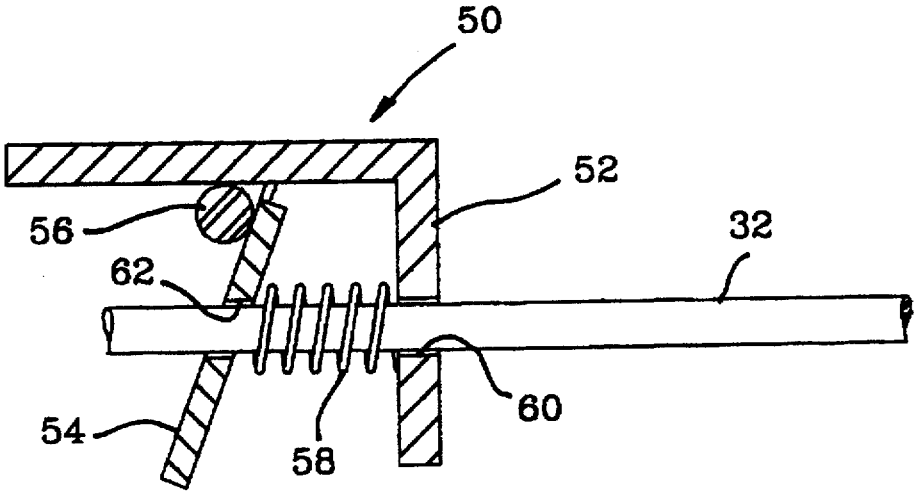
FIG. 4 is a detailed side sectional view of the lock portion of the invention.

The free end of the first arm is slideably engaged to the hanger 6 by means of lever lock 50, seen more particularly in FIG. 4. It will be seen that the lock could as well be mounted directly to the hinge structure 16, provided that it is mounted such that it moves in tandem with and effectively forms a part of the structure of the hanger. The lock is comprised of first and second lock members 52 and 54, respectively, both of which include platelike portions. The first lock member 52 is generally L-shaped and is mounted to the hanger 6 by way of a mounting bracket 56. The mounting bracket permits the lock to pivot in the horizontal plane in tandem with the footrest support structure. The second lock member 54 comprises a plate hinged to the first member. A spring 58 biases the second member away from the first member.

A pair of aligned apertures 60 and 62 extend through the respective members and are adapted to receive the first arm 32 of the link, which extends through both apertures and the spring. Locking action is achieved when the second member 54 is angled away from the first member, which results in the apertures 60 and 62 being slightly misaligned from each other. The lock is released as the respective members are drawn together, either by being directly drawn together or as a result of the first arm being pulled forwardly through the lock means as the footrest structure is elevated.

Figure 2:
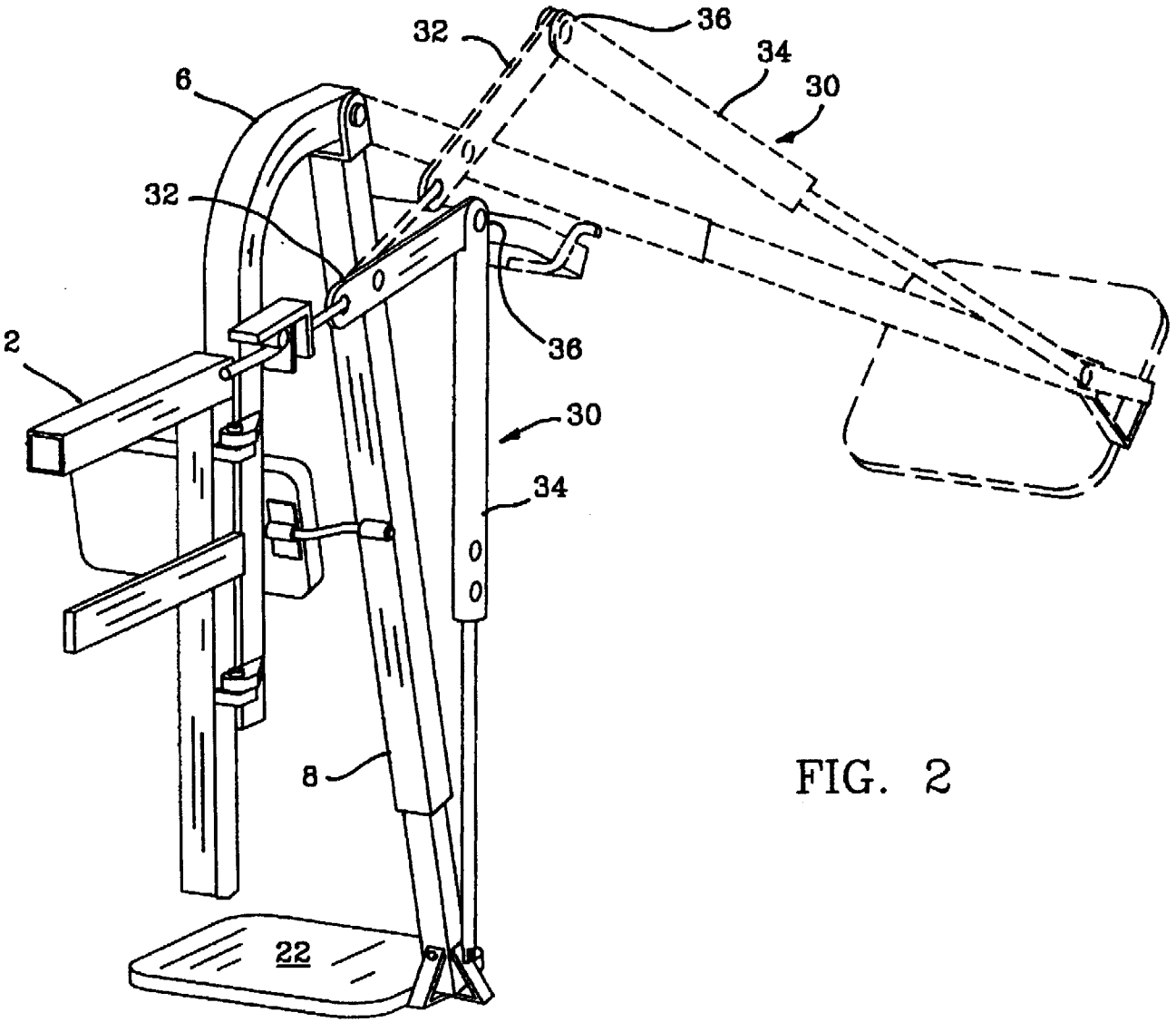
FIG. 2 is a perspective view of a portion of a wheelchair, showing the footrest in the lowered position and, in broken lines, in the elevated position.
Figure 3:
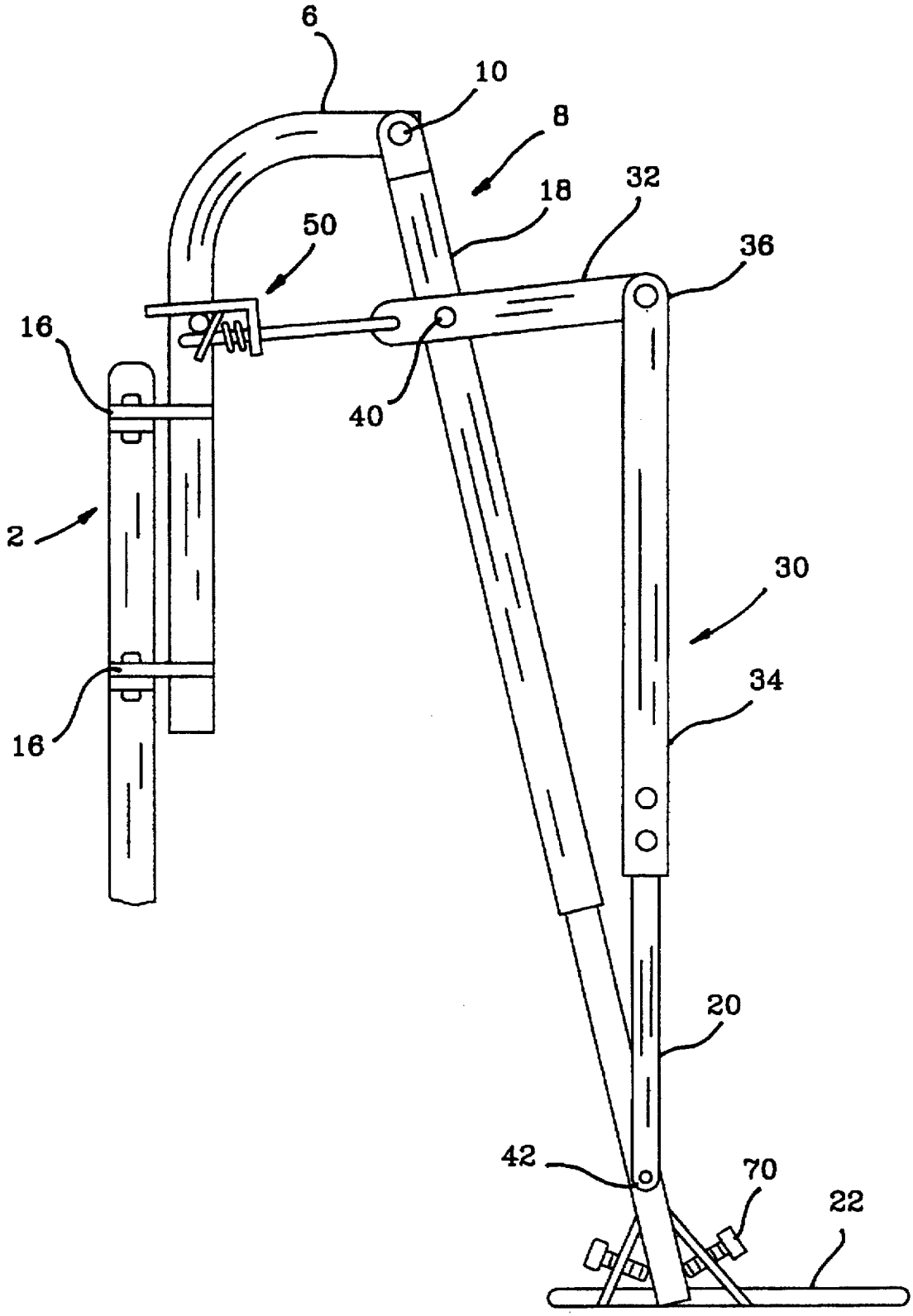
FIG. 3 is a side elevation view of a portion of a wheelchair, showing the footrest in lowered position.

Extension of the footrest support is achieved as the link unfolds as the leg is elevated; this in turn causes the distance between the pivots 40 and 42 to lengthen, as seen in FIG. 2, and extending the leg.

In use, the wheelchair user or an attendant elevates the footrest by lifting upwardly on the footrest. Upward movement of the footrest unfolds the link, which in turn drives the upper and lower legs apart and extends the overall length of the leg. Typically, the geometry of the various components permits about a two inch extension of the leg as the leg swings from a fully down to a fully up position. As the link unfolds, the first arm is drawn forwardly through the lever lock. Once the desired position of the footrest is achieved and the weight of the user's feet is placed on the footrest, the first arm of the link is forced rearwardly. This pushes apart the plates of the lever lock, locking the first arm within the lock and preventing downward motion of the footrest.

The footrest 22 may include angle adjustment means 70 to permit the user to adjust the angle of the footrest relative to the leg structure for greater comfort.

Figure 6:
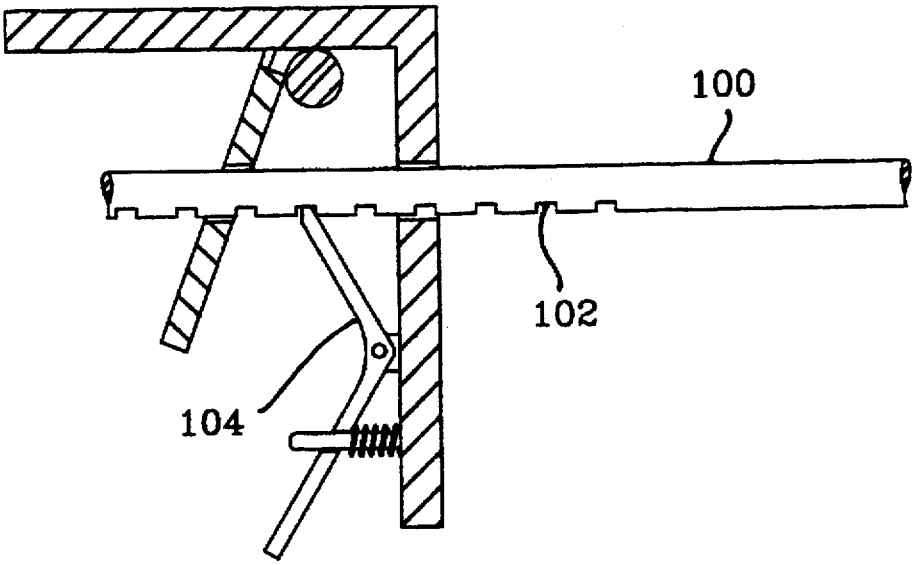
FIG. 6 is a detailed view of a second embodiment of the lock portion of the invention.
Figure 5:
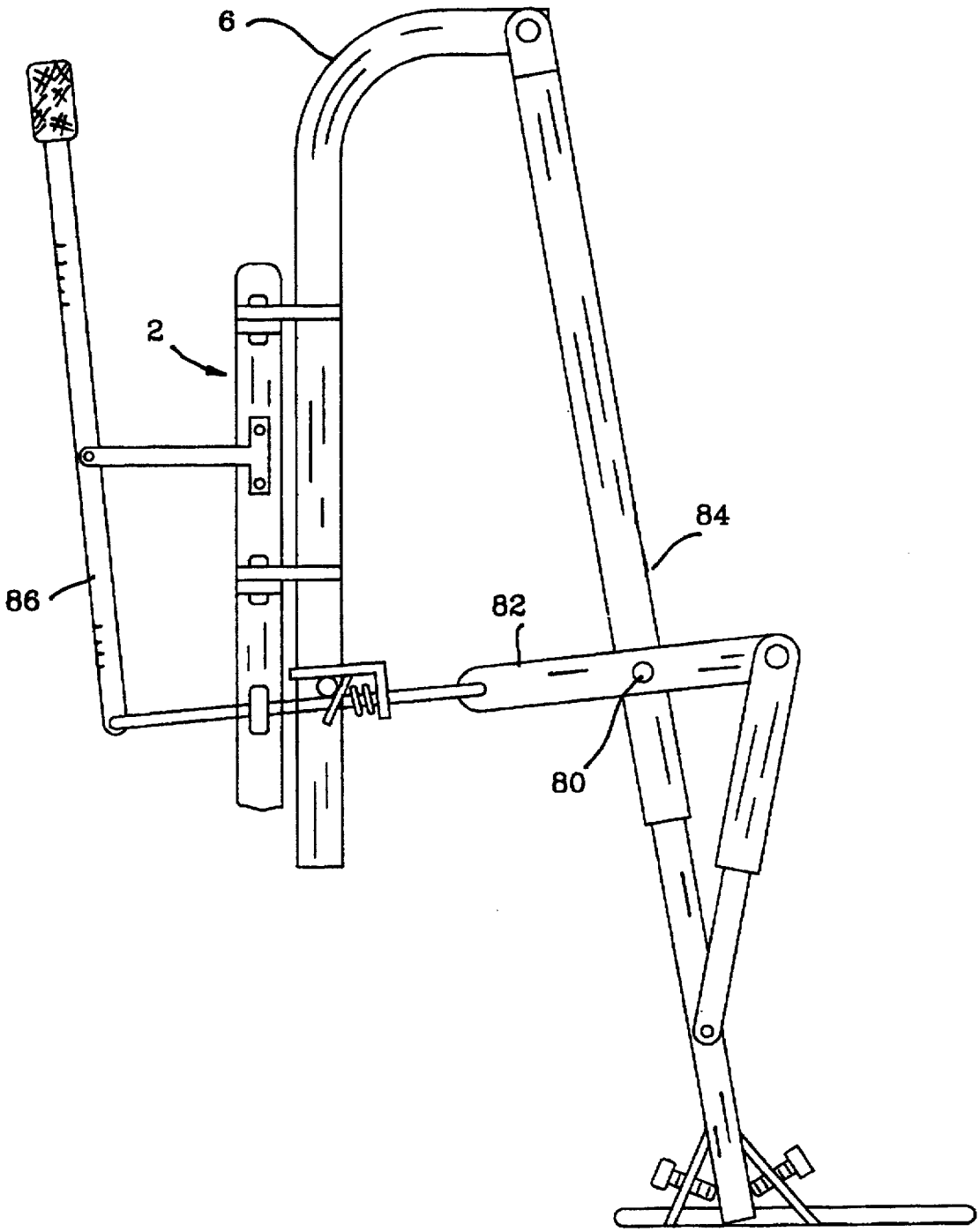
FIG. 5 is a side elevational view of a second embodiment of the invention.

A second embodiment of the invention, shown in FIG. 5, is adapted to permit a wheelchair user himself to elevate the footrest structure by pushing forwardly on the first arm of the link. In this version, the geometry of the respective members is changed to lower the relative position of the first arm, such that the pivot point 80 is adjacent the lower end of the upper leg 84. A handle 86 is provided on the free end of the first arm 82. The lever lock structure in this embodiment may either be the same as with the first embodiment, or alternatively it may incorporate a ratchet means that permits the user to drive the first arm forwardly by sequential actuation of the lever. An example of this type of arrangement is shown in FIG. 6. For this version, the first arm 100 is provided with a series of circumferential grooves 102 extending all or partway around the arm. The lever lock incorporates a spring-loaded ratchet plate 104 that engages the grooves sequentially and drives the arm forwardly with each actuation of the lock, in much the same manner as caulk gun.

It will be seen that although the present invention has been described by way of preferred embodiments thereof, numerous variations thereof and departures therefrom may be made, without departing from the spirit and scope of the invention, as defined in the appended claims.

We claim:

1. A wheelchair footrest structure for attachment to the frame of a wheelchair, said structure comprising:

a) an elongate leg structure comprising upper and lower coaxial legs slideably disposed relative to each other;

b) a footrest attached to the lower end of said leg structure;

c) a support attached to the leg structure and hinged to the wheelchair frame at a hinge to pivotally engage the leg structure to the wheelchair frame to permit the leg structure to swing in a generally vertical plane;

d) a folding link comprised of first and second arms, said first arm being pivotally engaged to said upper leg at a first pivot point intermediate the ends of said arm and said leg, respectively, and adapted to pivot in a generally vertical plane, said second arm being pivotally engaged at its lower end to said lower leg at a second pivot point, such that the distance between said first and second pivot points extends as the footrest support structure is elevated; and e) lock means attached to said support and adapted to releasably engage said first arm, to permit said first arm to slide freely through said lock in a first direction but not in a second direction until actuation of the lock.

2. A structure as in claim 1, wherein said second arm is adjustable in length.

3. A structure as in claim 2, wherein said second arm comprises a telescoping member having releasable attachment means to fix the length of said arm.

4. A structure as in claim 1, wherein there is further provided a hanger for said leg structure, linking the upper end of said leg structure with said wheelchair frame, said hanger having a hinge at a first end thereof to permit the footrest structure to pivot in the horizontal plane, said pivot means connecting a second end of said hanger with said leg structure.

5. A structure as in claim 1, wherein said lock means is attached to said wheelchair frame at said hinge.

6. A structure as in claim 1, wherein said lock means comprises first and second platelike members, hinged together and biased apart from each other so as to have a resting position angled away from each other, each of said platelike members having an aperture therethrough adapted to engage said first arm of said folding link whereby said arm is able to slide through said apertures when said platelike members are drawn together but is prevented from sliding therethrough when said plates are in their resting position.

7. A structure as in claim 1, wherein there is further provided a handle on said first arm to permit a user to elevate said leg support structure by pressing said handle forwardly.

8. A structure as in claim 1, wherein said lock means incorporates a releasable ratchet means to drive the first arm through said lock means so as permit the user to elevate the structure upon actuation of the ratchet means.

9. A structure as in claim 1, wherein said second arm is positioned generally forwardly of said leg structure, and said first arm extends rearwardly from said second arm towards said lock means.

10. A wheelchair having footrest structures, said structures each comprising:

a) an elongate leg structure comprising upper and lower coaxial legs slideably disposed relative to each other;

b) a footrest attached to the lower end of said leg structure;

c) a support attached to the leg structure and hinged to the wheelchair frame at a hinge to pivotally engage the leg structure to the wheelchair frame to permit the leg structure to swing in a generally vertical plane;

d) a folding link comprised of first and second arms, said first arm being pivotally engaged to said upper leg at a first pivot point intermediate the ends of said arm and said leg, respectively, and adapted to pivot in a generally vertical plane, said second arm being pivotally engaged at its lower end to said lower leg at a second pivot point, such that the distance between said first and second pivot points extends as the footrest support structure is elevated;

e) lock means attached to said support and adapted to releasably engage said first arm, to permit said first arm to slide freely through said lock in a first direction but not in a second direction until actuation of the lock.

11. A wheelchair as in claim 10, wherein said second arm is adjustable in length.

12. A wheelchair as in claim 11, wherein said second arm comprises a telescoping member having releasable attachment means to fix the length of said arm.

13. A wheelchair as in claim 10, wherein there is further provided a hanger for said leg structure, linking the upper end of said leg structure with said wheelchair frame, said hanger having a hinge at a first end thereof to permit the footrest structure to pivot in the horizontal plane, said pivot means connecting a second end of said hanger with said leg structure.

14. A wheelchair as in claim 10, wherein said lock means is attached to said wheelchair frame at said hinge.

15. A wheelchair as in claim 10, wherein said lock means comprises first and second platelike members, hinged together and biased apart from each other so as to have a resting position angled away from each other, each of said platelike members having an aperture therethrough adapted to engage said first arm of said folding link whereby said arm is able to slide through said apertures when said platelike members are drawn together but is prevented from sliding therethrough when said plates are in their resting position.

16. A wheelchair as in claim 10, wherein there is further provided a handle on said first arm to permit a user to elevate said leg support structure by pressing said handle forwardly.

17. A wheelchair as in claim 10, wherein said lock means incorporates a releasable ratchet means to drive the first arm through said lock means so as permit the user to elevate the structure upon actuation of the ratchet means.

18. A wheelchair as in claim 10, wherein said second arm is positioned generally forwardly of said leg structure, and said first arm extends rearwardly from said second arm towards said lock means.

* * * * *